US006154993A

United States Patent [19]

Menke et al.

[11] Patent Number: 6,154,993

[45] Date of Patent: Dec. 5, 2000

[54] LEAFABLE PROGRAM TABLE, PREFERABLY OF A MUSIC BOX

[75] Inventors: Wilhelm Menke; Börge Heidersberger, both of Bingen am Rhein, Germany

[73] Assignee: NSM Aktiengesellschaft, Bingen am Rhein, Germany

[21] Appl. No.: 09/168,862

[22] Filed: Oct. 9, 1998

[30] Foreign Application Priority Data

Oct. 21, 1997 [DE] Germany ..... 297 18 667 U

[51] Int. Cl.[7] ..... G09F 19/00; G09F 11/30

[52] U.S. Cl. ..... 40/537; 40/530; 40/492; 40/510

[58] Field of Search ..... 40/537, 530, 124.4, 40/124, 492, 510, 716, 777; 211/40

[56] References Cited

U.S. PATENT DOCUMENTS

| | | | |
|---|---|---|---|
| 3,543,426 | 5/1968 | Sakamoto | 40/710 |
| 4,202,122 | 5/1980 | Namiki | 40/710 |
| 4,831,758 | 5/1989 | Williams et al. | 40/510 |
| 5,031,346 | 7/1991 | Herring et al. | 40/510 X |
| 5,040,687 | 8/1991 | Whittington | 211/40 |
| 5,259,517 | 11/1993 | Pancoe | 40/124 X |

FOREIGN PATENT DOCUMENTS 0 441 949 8/1991 European Pat. Off. .

*Primary Examiner*—Terry Lee Melius
*Assistant Examiner*—Rodrigo J. Morales
*Attorney, Agent, or Firm*—Jacobson, Price, Holman & Stern, PLLC

[57] ABSTRACT

A leafable program table for use in a music box includes a frame having opposed end and side peripheral strips and a plurality of intersecting strips forming a row of rectangular fields and a row of approximately square fields. The square fields are larger than the rectangular fields. Title pages of content booklets for compact discs may be held in the square fields, and lists of song titles may be held in the rectangular fields. Each rectangular field also includes a recessed field into which a numbered label corresponding to a compact disc may be adhered.

11 Claims, 6 Drawing Sheets

LEAFABLE PROGRAM TABLE, PREFERABLY OF A MUSIC BOX

BACKGROUND OF THE INVENTION

1. Field of the Invention

The invention relates to a leafable program table, preferably of a music box.

2. Description of the Related Art

For example, the EP 0 441 949 B1 discloses a device for leafing through the program tables of a music box, in which the individual program tables, which are in two stacks, are stored side-by-side in such a manner in a housing behind its two windows so as to pivot at their swivel axles, located at their rear ends, that they can be turned over individually by means of a strip, which can be moved back and forth by a drive and which is provided with stops, which engage with the nose-shaped continuations of the program tables, which project beyond the swivel axles. The program tables contain title pages (covers) of the playable CD's so that a person, operating the music box, can inform himself quickly about the existing titles that can be played by leafing through the program tables. The prior art program tables consist of three identical rectangular areas, which are arranged one below the other and are covered by the title pages of the content booklets.

SUMMARY OF THE INVENTION

The object of the invention is to produce in a simple manner that offers a saving of material program tables of the aforementioned kind, which can hold both the title pages of the content booklets and the lists of titles of playable CD's side-by-side in lines.

The invention achieves this object by providing a rectangular frame, which is made of profiled peripheral strips and which is provided with intersecting strips, which run parallel to other peripheral strips and are connected to opposite peripheral strips, and with each other and other peripheral strips define the rectangular fields; and by molding wall segments, provided with average blanks, to the peripheral strips and the intersecting strips approximately in the center plane of the frame; by molding the tongue-like projections, overlapping the plane of the wall segments, to the peripheral strips and the intersecting strips; and by providing boreholes on the opposing ends of a peripheral strip, in order to receive the joint bolts and between the same the continuations, which serve the purpose of turning the program table over.

The program tables of the invention can be produced in a simple manner as injection molded parts, for example plastic injection molded parts. Since the program table consists essentially of only skeleton-like peripheral strips and between the same intersecting strips, to which bezel sections enclosing the blanks are molded, they can be produced with a relatively small amount of material.

The program table of the invention also exhibits good rigidity, since the peripheral intersecting strips and strips stand at right angles on the wall segments, enclosed by said strips, and project slightly beyond them so that the peripheral intersecting strips and the strips have an adequately large geometrical moment of inertia, which guarantees the rigidity.

The bezel parts border the blanks which have concavely or convexly rounded corners.

It is expedient for the fields to be side-by-side in lines, in order to hold the title pages (covers) of the content booklets and the lists of titles of the playable CD's.

The top wall segments of the surrounding wall segments of the fields for the lists of titles can be provided with embedded and recessed fields to receive marks or labels with numbers. In this design the lists of titles are provided with window-like break-throughs, which are punched to match and in which then the numbers, printed on the labels, appear. These numbers characterize the selected CD so that a selected title can be entered in the form of the CD number and the number of the selected title into the keyboard of the music box, serving the selection.

If the lists of titles are not provided with window-like break-throughs so that they cover the recessed fields, provided in the surrounding wall segments, these recessed fields can also be arranged in tongue-like projections, which serve to grasp and hold the lists of titles.

For reasons relating to the injection technology the wall segments exhibit expediently break-throughs in the region of the overlapping tongues.

One embodiment of the invention is explained in detail with reference to the drawings in the following.

DETAILED DESCRIPTION OF THE PREFERRED EMBODIMENTS

Figure 1:
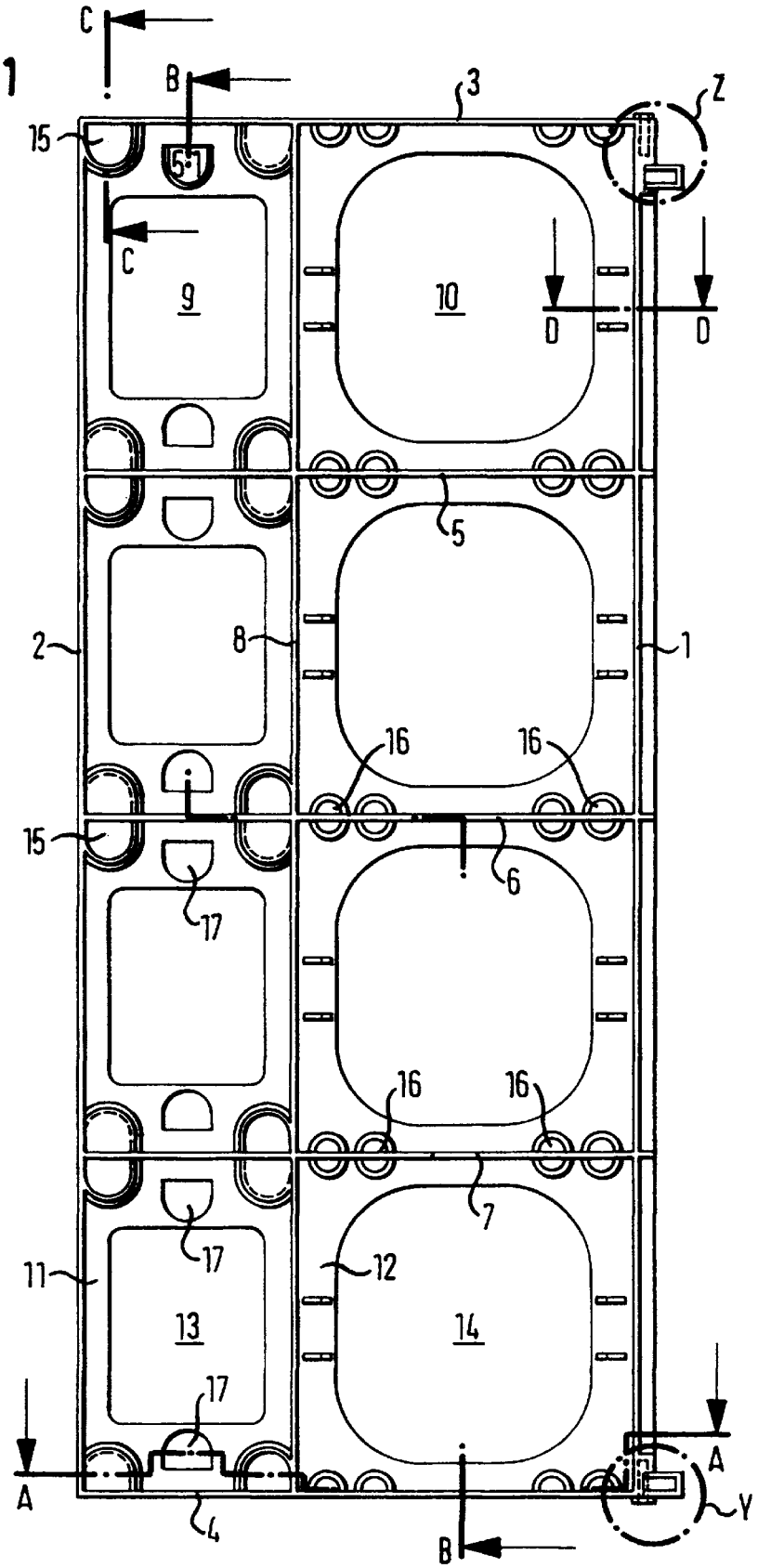
FIG. 1 is a top view of a program table.

The program table comprises a rectangular frame, which is made of peripheral strips 1, 2 and 3, 4, which are connected together at the ends, and of intersecting strips 5 to 7 and 8, of which the ends of the strip 8 are connected to the narrow peripheral strips 3, 4 and the ends of the strips 5 to 7 are connected to the long peripheral strips 1, 2. The strip 8 runs parallel to the long peripheral strips 1, 2 and the strips 5 to 7 run parallel to the short peripheral strips 3, 4. The strips 5 to 7 exhibit the same distances from each other and to the peripheral strips 3, 4.

The strips 5 to 7 divide the program table into four, approximately identical segments. These segments are divided by the strip 8 into one rectangular field 9 and one approximately square field 10, both of which lie next to one another. The rectangular field 9 serves to receive and hold the lists of titles, and the approximately square field 10 serves to receive and hold the title pages of the content booklets of the playable CD's.

The individual fields 9, 10 are enclosed by the peripheral strips and the intersecting strips of the center plane of the program table as are the surrounding wall segments 11, 12, which border approximately rectangular break-throughs 13, 14 with rounded corners. These wall segments form the supports to hold the lists of titles and title pages inserted into the fields.

The external edges of the peripheral strips 3, 4 and the intersecting strips 5 to 7 have tongues 15, 16, which overlap the plane of the wall segments 11, 12 with a slight space. These tongues serve to hold the inserted title pages and the lists of titles.

The top and bottom wall segments of the rectangular fields 9 are provided with intakes 17, formed by recesses, into which labels can be cemented, whose shape matches the intakes and which bear the numbers of the playable CD's.

The rear side of the program table, visible in FIG. 1, is made the same way so that title pages and lists of titles can be inserted into the identical fields of the front and back side of the program table, for a left side and a right side of the front and back side, respectively.

Figure 2:
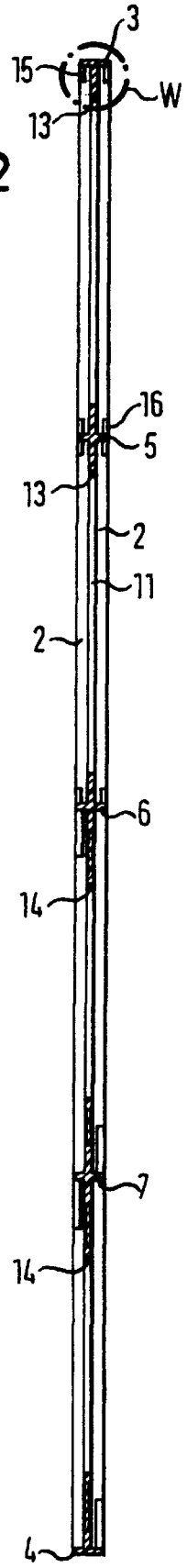
FIG. 2 is a view through the program table according to FIG. 1 along the line B—B.

The view according to FIG. 2 shows the wall segments 11 of the fields 9 and the ends of the peripheral strip 2 overlapping them.

Figure 3:
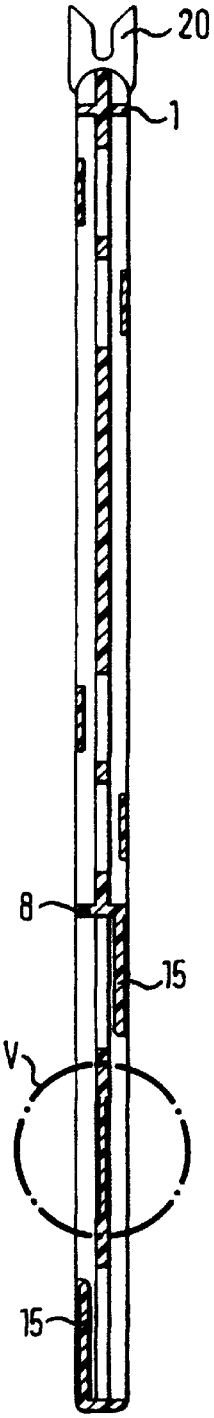
FIG. 3 is a view through the program table according to FIG. 1 along the line A—A.
Figure 4:
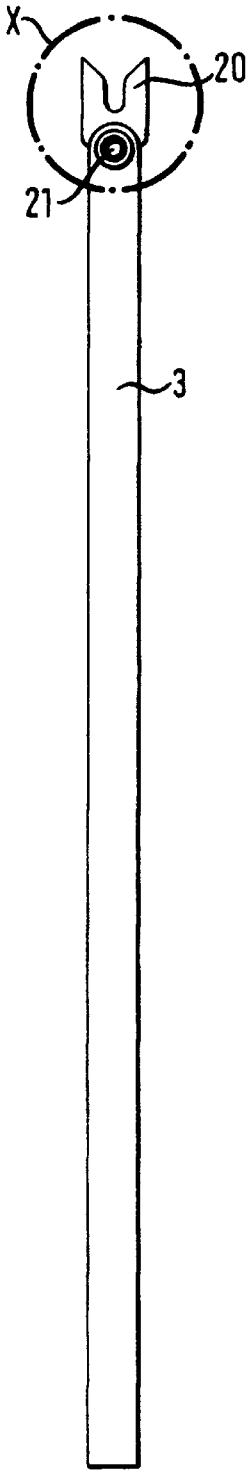
FIG. 4 is an end view of the program table according to FIG. 1.

FIG. 3 shows the continuations 20, which are connected to the peripheral strip 1 and which serve to turn over the program tables, which are collected together like a book into a stack. As obvious from FIG. 4, the top and bottom ends of the peripheral strip 1 have blind-hole-like depressions 21, with which the pins holding the program table engage.

Figure 5:
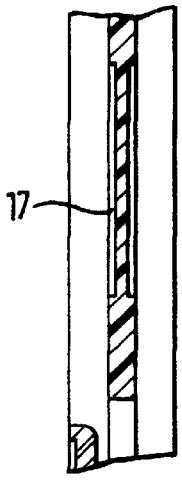
FIG. 5 is an enlarged view of the circled part V in FIG. 3.

FIG. 5 is a view of the recess 17 in the top and bottom wall segments of the rectangular fields, which serves to hold the labels exhibiting the numbers.

Figure 6:
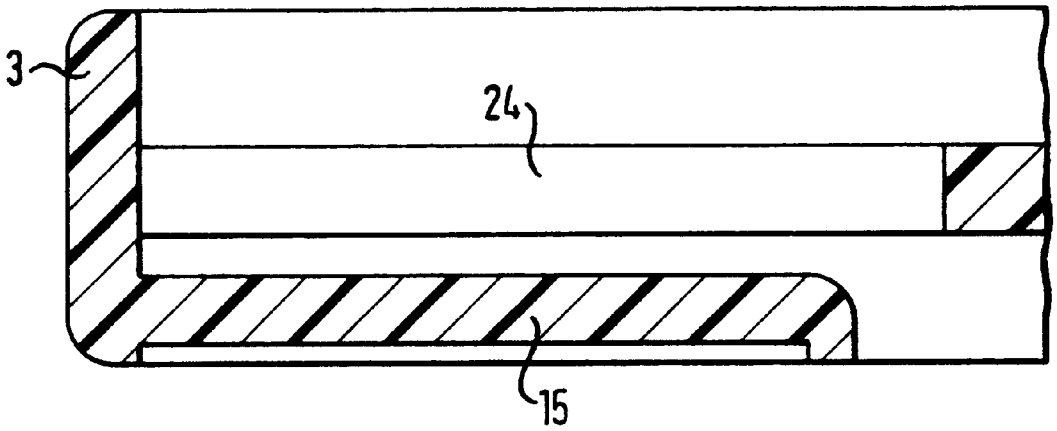
FIG. 6 is an enlarged view of the program table along the line C—C in FIG. 1.

FIG. 6 depicts the tongue 15, which is molded to the top peripheral strip 3 and which serves to hold the list of titles inserted into the field 9. Below the tongue 15 the wall segment 11 exhibits a break-through 24.

Figure 7:
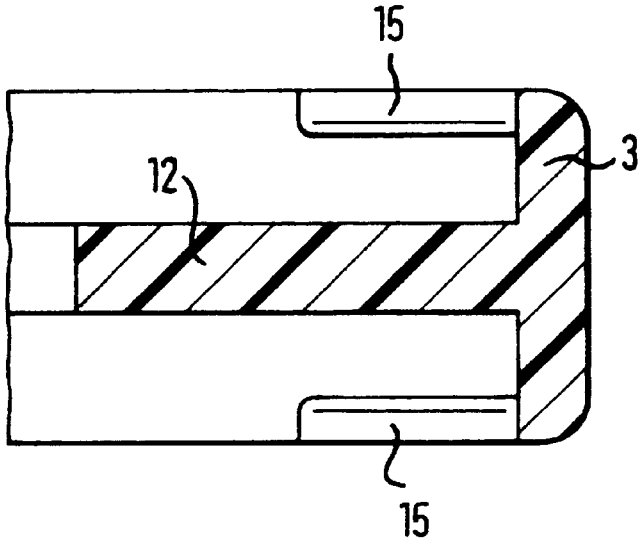
FIG. 7 is an enlarged view of the circled part W in FIG. 2.

FIG. 7 shows the top peripheral strip 3 and the wall segment 12, molded thereto.

Figure 8:
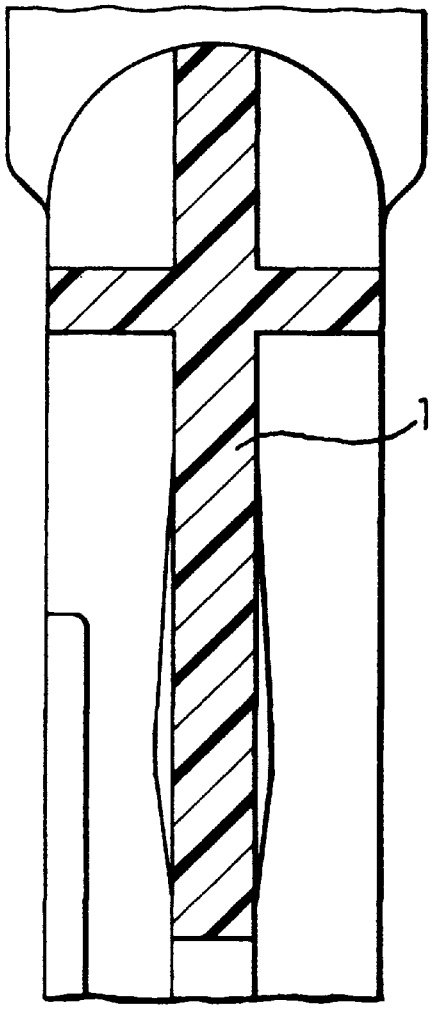
FIG. 8 is an enlarged view along the line D—D in FIG. 1.
Figure 9:
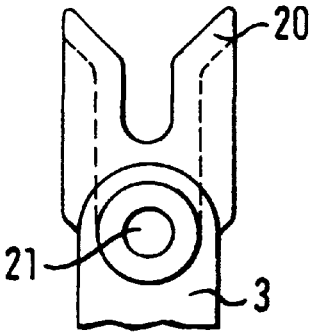
FIG. 9 is an enlarged view of the circled part X in FIG. 4.

FIG. 8 is a view of the peripheral strip 1 along the line D—D.

Figure 10:
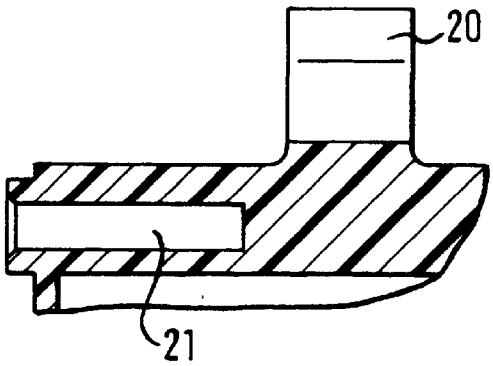
FIG. 10 is an enlarged view of the circled part Z in FIG. 1.
Figure 11:
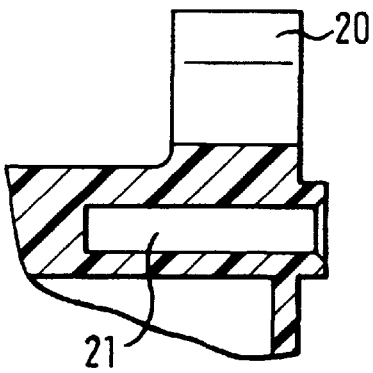
FIG. 11 is an enlarged view of the circled part Y in FIG. 1.

FIGS. 10 and 11 depict the top and bottom blind holes 21 of the peripheral strip 1, which serve to receive the joint bolts.

What is claimed is:

1. A leafable program table having a unitary rectangular frame made of injection molded plastic comprising:

opposed end and side peripheral strips;

one or more intersecting strips, which run parallel to one of said end peripheral strips and said side peripheral strips and are connected to respective opposing peripheral strips, the peripheral and intersecting strips defining a first plurality of rectangular fields and a second plurality of approximately square fields, said second plurality of approximately square fields being larger than said first plurality of rectangular fields;

said first plurality of rectangular fields and said second plurality of approximately square fields having wall segments provided with break-throughs therein;

tongue-like projections being provided on edges of said peripheral strips and intersecting strips;

wall segments of said first plurality of rectangular fields including recessed fields for receiving numbered labels;

boreholes on opposing ends of one of said peripheral strips to receive joint bolts; and continuations on said one peripheral strip to turn the program table over.

2. The program table, as claimed in claim 1, wherein the break-throughs have at least one rounded corner.

3. The program table, as claimed in claim 1, wherein title pages (covers) of content booklets and lists of song titles of playable CD's may be held in said approximately square fields and said rectangular fields. respectively, adjacent to each other.

4. The program table, as claimed in claim 1, wherein the wall segments have additional break-throughs in a region of the tongue-like projections.

5. A leafable program table having a rectangular frame for displaying compact disc covers and lists of song titles in a music box comprising:

four peripheral strips joined by a plurality of intersecting strips, each of said plurality of intersecting strips running parallel to two of the four peripheral strips and further being connected at its ends to the other two of the four peripheral strips such that the peripheral and intersecting strips define a first plurality of rectangular fields aligned in a first single row, and a second plurality of rectangular fields aligned in a second single row parallel with the first plurality of rectangular fields, the second plurality of rectangular fields being greater in width than said first plurality of rectangular fields;

each of said first and second plurality of rectangular fields including a wall segment and a centrally disposed break-through;

each of said first plurality of rectangular fields adjacent to and in alignment with a respective one of the second plurality of rectangular fields such that a list of song titles may be displayed in each of said first plurality of rectangular fields and a CD cover corresponding to a particular list may be displayed in a respective one of the second plurality of rectangular fields that is adjacent to and in alignment with the particular list;

said peripheral and intersecting strips including tongue-like projections for holding the lists of song titles and the CD covers; and said first plurality of rectangular fields including recessed fields for receiving numbered labels designating a CD selection.

6. The leafable program table as set forth in claim 5, wherein one peripheral strip includes, at its opposing ends, boreholes to receive joint bolts and continuations to turn the program table over.

7. The leafable program table as set forth in claim 5, wherein the frame is made of injection molded plastic.

8. A leafable program table comprising:

a rectangular frame formed by four peripheral strips joined by a plurality of intersecting strips, each of said plurality of intersecting strips running parallel to two of the four peripheral strips and further being connected at its ends to the other two of the four peripheral strips such that the peripheral and intersecting strips define a first plurality of rectangular fields and a second plurality of approximately square fields within the rectangular frame;

each of said first plurality of rectangular fields and said second plurality of approximately square fields including a wall segment and a centrally disposed break-through;

said first plurality of rectangular fields aligned next to and corresponding on a one-to-one basis with the second plurality of approximately square fields, each of said second plurality of approximately square fields being larger than a corresponding rectangular field of the first plurality of rectangular fields;

said peripheral and intersecting strips including tongue-like projections for holding items in the first plurality of rectangular fields and in the second plurality of approximately square fields;

said wall segments of said first plurality of rectangular fields including recessed fields for receiving numbered labels;

wherein opposing ends of one peripheral strip include boreholes to receive joint bolts and continuations to turn the program table over.

9. The program table as set forth in claim 8, wherein the tongue-like projections are for holding compact disc (CD) covers and lists of song titles, each one of said first plurality of rectangular fields for holding a list of song titles and each one of the second plurality of approximately square fields for holding a CD cover, corresponding to a particular list, adjacent to and in alignment with the particular list.

10. The leafable program table as set forth in claim 8, wherein the first plurality of rectangular fields are aligned in a first row, and the second plurality of approximately square fields are aligned in a second row, the second row being parallel with the first row.

11. The leafable program table as set forth in claim 8, wherein the frame is made by a process of plastic injection molding.

* * * * *